US008737633B2

(12) United States Patent
Sibbald et al.

(10) Patent No.: US 8,737,633 B2
(45) Date of Patent: May 27, 2014

(54) NOISE CANCELLATION SYSTEM WITH GAIN CONTROL BASED ON NOISE LEVEL

(75) Inventors: Alastair Sibbald, Cookham (GB); Robert David Alcock, Iver (GB)

(73) Assignee: Wolfson Microelectronics plc, Edinburgh (GB)

( * ) Notice: Subject to any disclaimer, the term of this patent is extended or adjusted under 35 U.S.C. 154(b) by 719 days.

(21) Appl. No.: 12/808,616

(22) PCT Filed: Dec. 11, 2008

(86) PCT No.: PCT/GB2008/051177

§ 371 (c)(1), (2), (4) Date: Jul. 8, 2010

(87) PCT Pub. No.: WO2009/081185

PCT Pub. Date: Jul. 2, 2009

(65) Prior Publication Data

US 2010/0266137 A1 Oct. 21, 2010

(30) Foreign Application Priority Data

Dec. 21, 2007 (GB) ..... 0725110.1
Jun. 16, 2008 (GB) ..... 0810997.7

(51) Int. Cl.
*G10K 11/178* (2006.01)

(52) U.S. Cl.
USPC ..... 381/71.1; 381/71.2; 381/71.6; 381/71.8

(58) Field of Classification Search
USPC ..... 381/94.7, 71.2, 71.1, 71.8, 71.6
See application file for complete search history.

(56) References Cited

U.S. PATENT DOCUMENTS

| | | | | |
|---|---|---|---|---|
| 4,630,304 | A | 12/1986 | Borth et al. | |
| 5,907,624 | A | 5/1999 | Takada | |
| 7,103,188 | B1 | 9/2006 | Jones | |
| 2005/0190927 | A1 * | 9/2005 | Petroff | 381/59 |
| 2009/0150144 | A1 * | 6/2009 | Nongpiur et al. | 704/233 |
| 2009/0225997 | A1 * | 9/2009 | Alves et al. | 381/66 |

FOREIGN PATENT DOCUMENTS

| | | | |
|---|---|---|---|
| CN | 1640191 | A | 7/2005 |
| EP | 0 390 386 | A2 | 10/1990 |
| EP | 0 967 592 | A2 | 12/1999 |
| JP | 5-11772 | A | 1/1993 |
| JP | 3112268 | B2 | 11/2000 |
| JP | 2007-2393 | A | 1/2007 |

(Continued)

*Primary Examiner* — Duc Nguyen
*Assistant Examiner* — George Monikang
(74) *Attorney, Agent, or Firm* — Dickstein Shapiro LLP

(57) ABSTRACT

A noise cancellation system is provided, for generating a noise cancellation signal to be added to a wanted signal to mitigate the effects of ambient noise. The system comprises: an input, for receiving an input signal representing ambient noise; a detector, for detecting a magnitude of said input signal; and a voice activity detector, for determining voiceless periods when said input signal does not contain a signal representing a voice. The detector is adapted to detect the magnitude of said input signal during said voiceless periods, and the system is adapted to operate in a first mode when said input signal is above a threshold value, and a second mode when said input signal is below the threshold value. The first mode comprises generating a noise cancellation signal with a first magnitude for at least partially cancelling the ambient noise. The second mode comprises generating a noise cancellation signal with a second magnitude that is less than the first magnitude.

22 Claims, 4 Drawing Sheets

(56) References Cited

FOREIGN PATENT DOCUMENTS

| | | | |
|---|---|---|---|
| JP | 2007-259241 | A | 10/2007 |
| WO | WO 87/00366 | A1 | 1/1987 |
| WO | WO 95/00946 | A1 | 1/1995 |
| WO | WO 01/73759 | A1 | 10/2001 |

* cited by examiner

NOISE CANCELLATION SYSTEM WITH GAIN CONTROL BASED ON NOISE LEVEL

The present invention relates to noise cancellation systems, and in particular to a method for controlling the noise cancellation on the basis of the detected ambient noise.

BACKGROUND

Noise cancellation systems are known, in which an electronic noise signal representing ambient noise is applied to a signal processing circuit, and the resulting processed noise signal is then applied to a speaker, in order to generate a sound signal. In order to achieve noise cancellation, the generated sound should approximate as closely as possible the inverse of the ambient noise, in terms of its amplitude and its phase.

In particular, feedforward noise cancellation systems are known, for use with headphones or earphones, in which one or more microphones mounted on the headphones or earphones detect an ambient noise signal in the region of the wearer's ear. In order to achieve noise cancellation, the generated sound then needs to approximate as closely as possible the inverse of the ambient noise, after that ambient noise has itself been modified by the headphones or earphones. One example of modification by the headphones or earphones is caused by the different acoustic path the noise must take to reach the wearer's ear, travelling around the edge of the headphones or earphones.

However, noise cancellation systems are generally employed in applications where it is highly desirable to reduce power consumption. For example, portable music players and mobile phones have limited battery resources, and therefore efforts should be made in order to reduce the drain on these resources. Noise cancellation is one such drain, and therefore it is desirable to design a noise cancellation system that is as efficient as possible.

SUMMARY OF INVENTION

According to a first aspect of the present invention, there is provided a noise cancellation system, for generating a noise cancellation signal to be added to a wanted signal to mitigate the effects of ambient noise. The noise cancellation system comprises an input, for receiving an input signal representing ambient noise; a detector, for detecting a magnitude of said input signal; and a voice activity detector, for determining voiceless periods when said input signal does not contain a signal representing a voice. The detector is adapted to detect the magnitude of said input signal during said voiceless periods. The system is adapted to operate in a first mode when said input signal is above a threshold value, and a second mode when said input signal is below the threshold value. The first mode comprises generating a noise cancellation signal with a first magnitude for at least partially cancelling the ambient noise. The second mode comprises generating a noise cancellation signal with a second magnitude that is less than the first magnitude.

According to a second aspect of the present invention, there is provided a noise cancellation system, for generating a noise cancellation signal to be added to a wanted signal to mitigate the effects of ambient noise. The system comprises an input, for receiving a signal representing ambient noise; a detector, for detecting a magnitude of said ambient noise signal; and a voice activity detector, for determining voiceless periods when said input signal does not contain a signal representing a voice. The detector is adapted to detect the magnitude of said input signal during said voiceless periods. The system is adapted to operate in a normal mode when said ambient noise signal is above a threshold value, and adapted to switch off when the ambient noise signal is below the threshold value. The normal mode comprises generating a noise cancellation signal for at least partially cancelling the ambient noise.

The present invention also provides corresponding methods to each of the noise cancellation systems described above.

According to alternative aspects of the present invention, there is provided a noise cancellation system, for generating a noise cancellation signal to be added to a wanted signal to mitigate the effects of ambient noise. The system comprises an input, for receiving an input signal representing ambient noise; and a detector, for detecting a magnitude of said input signal. The system is adapted to operate in a first mode when said input signal is above a threshold value, and a second mode when said input signal is below the threshold value. The first mode comprises generating a noise cancellation signal with a first magnitude for at least partially cancelling the ambient noise. The second mode comprises generating a noise cancellation signal with a second magnitude that is less than the first magnitude. The system is adapted to transition from the first mode to the second mode when the magnitude of the input signal falls below the first threshold value, and the system is adapted to transition from the second mode to the first mode when the magnitude of the input signal rises above a second threshold value, where the second threshold value is greater than the first threshold value.

There is also provided a noise cancellation system, for generating a noise cancellation signal to be added to a wanted signal to mitigate the effects of ambient noise. The system comprises an input, for receiving a signal representing ambient noise; and a detector, for detecting a magnitude of said ambient noise signal. The system is adapted to operate in a normal mode when said ambient noise signal is above a threshold value, and adapted to switch off when the ambient noise signal is below the threshold value. The normal mode comprises generating a noise cancellation signal for at least partially cancelling the ambient noise. The system is adapted to transition from the normal mode to being switched off when the magnitude of the input signal falls below the first threshold value, and the system is adapted to transition from being switched off to the normal mode when the magnitude of the input signal rises above a second threshold value, where the second threshold value is greater than the first threshold value.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 1:
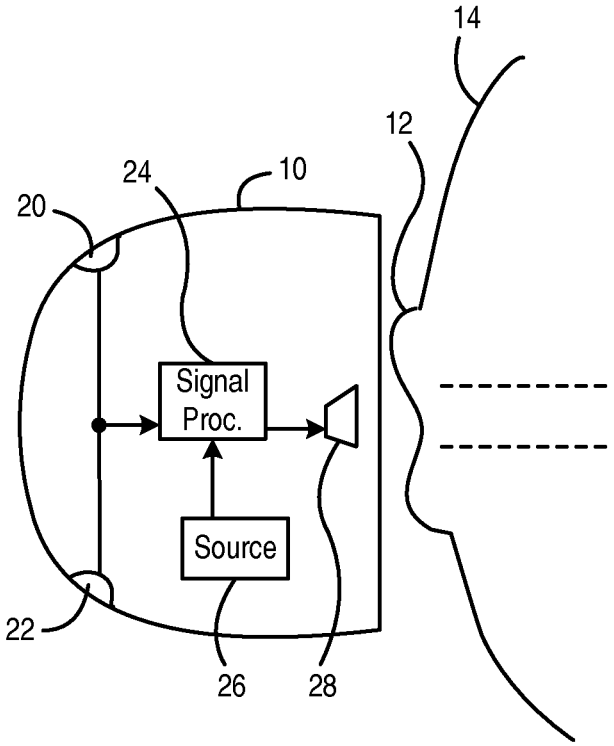
FIG. 1 illustrates a noise cancellation system in accordance with an aspect of the invention.

FIG. 1 illustrates in general terms the form and use of a noise cancellation system in accordance with the present invention.

Specifically, FIG. 1 shows an earphone 10, being worn on the outer ear 12 of a user 14. Thus, FIG. 1 shows a supra-aural earphone that is worn on the ear, although it will be appreciated that exactly the same principle applies to circumaural headphones worn around the ear and to earphones worn in the ear such as so-called ear-bud phones. The invention is equally applicable to other devices intended to be worn or held close to the user's ear, such as mobile phones and other communication devices.

Ambient noise is detected by microphones 20, 22, of which two are shown in FIG. 1, although any number more or less than two may be provided. Ambient noise signals generated by the microphones 20, 22 are combined, and applied to signal processing circuitry 24, which will be described in more detail below. In one embodiment, where the microphones 20, 22 are analogue microphones, the ambient noise signals may be combined by adding them together. Where the microphones 20, 22 are digital microphones, i.e. where they generate a digital signal representative of the ambient noise, the ambient noise signals may be combined alternatively, as will be familiar to those skilled in the art. Further, the microphones could have different gains applied to them before they are combined, for example in order to compensate for sensitivity differences due to manufacturing tolerances.

This illustrated embodiment of the invention also contains a source 26 of a wanted signal. For example, where the noise cancellation system is in use in an earphone, such as the earphone 10 that is intended to be able to reproduce music with a relatively high quality, the source 26 may be an inlet connection for a wanted signal from an external source such as a sound reproducing device. In other applications, for example where the noise cancellation system is in use in a mobile phone or other communication device, the source 26 may include wireless receiver circuitry for receiving and decoding radio frequency signals.

The wanted signal from the source 26 is applied through the signal processing circuitry 24 to a loudspeaker 28, which generates a sound signal in the vicinity of the user's ear 12. In addition, the signal processing circuitry 24 generates a noise cancellation signal that is also applied to the loudspeaker 28.

One aim of the signal processing circuitry 24 is to generate a noise cancellation signal, which, when applied to the loudspeaker 28, causes it to generate a sound signal in the ear 12 of the user that is the inverse of the ambient noise signal reaching the ear 12.

In order to achieve this, the signal processing circuitry 24 needs to generate from the ambient noise signals generated by the microphones 20, 22 a noise cancellation signal that takes into account the properties of the microphones 20, 22 and of the loudspeaker 28, and also takes into account the modification of the ambient noise that occurs due to the presence of the earphone 10.

According to the present invention, the signal processor 24 includes means for measuring the level of ambient noise and for controlling the addition of the noise cancellation signal to the source signal based on the level of ambient noise. For example, in environments where ambient noise is low or negligible, noise cancellation may not improve the sound quality heard by the user. That is, the noise cancellation may even add artefacts to the sound stream to correct for ambient noise that is not present. Further, the activity of the noise cancellation system during such periods consumes power that is wasted. Therefore, when the noise signal is low, the noise cancellation signal may be reduced, or even turned off altogether. This saves power and prevents the noise signal from adding unwanted noise to the voice signal.

However, when the noise cancellation system is present in a mobile phone or headset, for example, the ambient noise may be detected in isolation from the user's own voice. That is, a user may be speaking on a mobile phone or headset in an otherwise empty room, but the noise cancellation system may still not detect that noise is low due to the user's voice.

Figure 2:
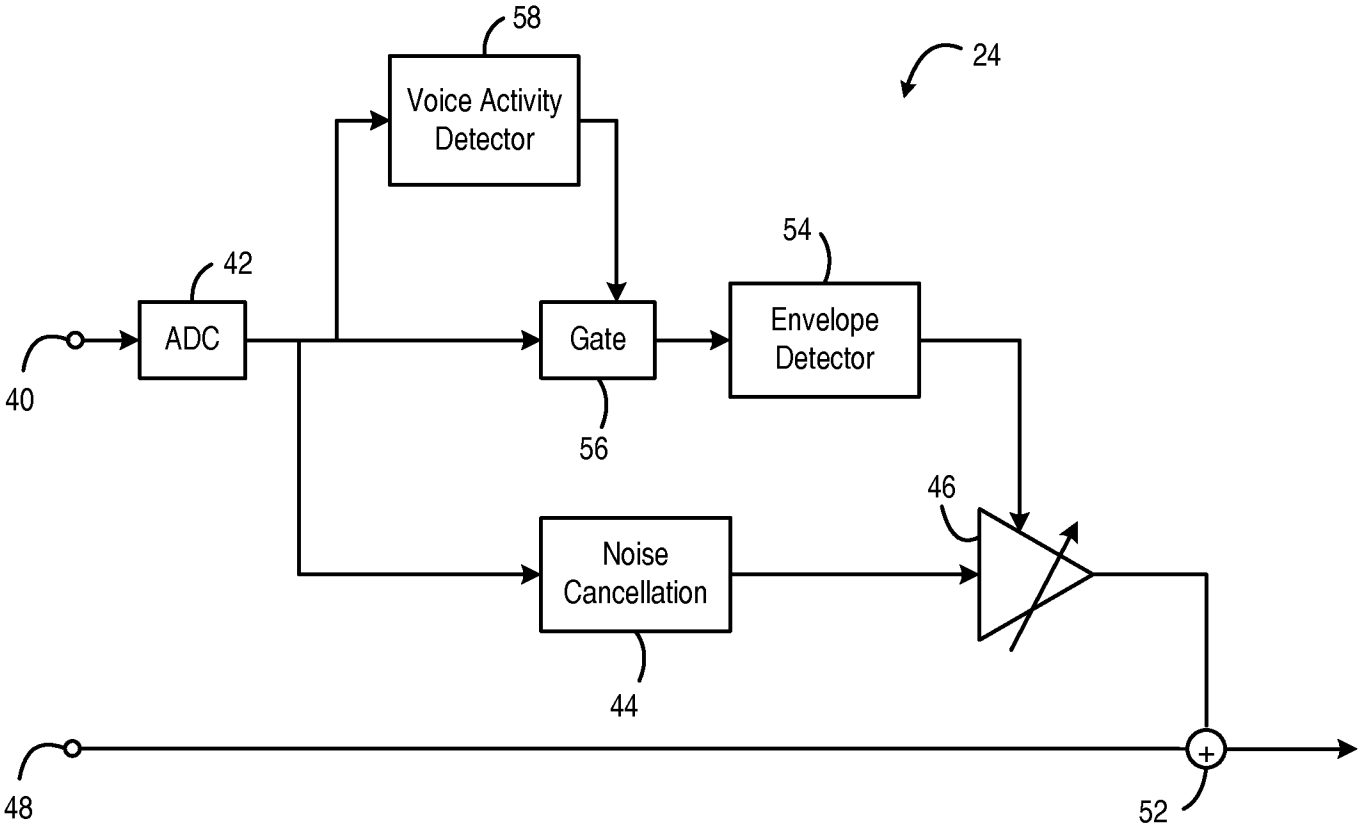
FIG. 2 illustrates a signal processing circuit in accordance with an aspect of the invention in the noise cancellation system of FIG. 1.

FIG. 2 shows in more detail one embodiment of the signal processing circuitry 24. An input 40 is connected to receive a noise signal, for example directly from the microphones 20, 22, representative of the ambient noise. The noise signal is input to an analogue-to-digital converter (ADC) 42, and is converted to a digital noise signal. The digital noise signal is input to a noise cancellation block 44, which outputs a noise cancellation signal. The noise cancellation block 44 may for example comprise a filter for generating a noise cancellation signal from a detected ambient noise signal, i.e. the noise cancellation block 44 substantially generates the inverse signal of the detected ambient noise. The filter may be adaptive or non-adaptive, as will be apparent to those skilled in the art.

The noise cancellation signal is output to a variable gain block 46. The control of the variable gain block 46 will be explained later. Conventionally, a gain block may apply gain to the noise cancellation signal in order to generate a noise cancellation signal that more accurately cancels the detected ambient noise. Thus, the noise cancellation block 44 will typically comprise a gain block (not shown) designed to operate in this manner. However, according to one embodiment of the present invention the applied gain is varied according to the detected amplitude, or envelope, of ambient noise. The variable gain block 46 may therefore be in addition to a conventional gain block present in the noise cancellation block 44, or may represent the gain block in the noise cancellation block 44 itself, adapted to implement the present invention.

The signal processor 24 further comprises an input 48 for receiving a voice or other wanted signal, as described above. Thus, in the case of a mobile phone, the wanted signal is the signal that has been transmitted to the phone, and is to be converted to an audible sound by means of the speaker 28. In general, the wanted signal will be digital (e.g. music, a received voice, etc), in which case the wanted signal is added to the noise cancellation signal output from the variable gain block 46 in an adding element 52. However, in the case that the wanted signal is analogue, the wanted signal is input to an ADC (not shown), where it is converted to a digital signal, and then added in the adding element 52. The combined signal is then output from the signal processor 24 to the loudspeaker 28.

Figure 3:
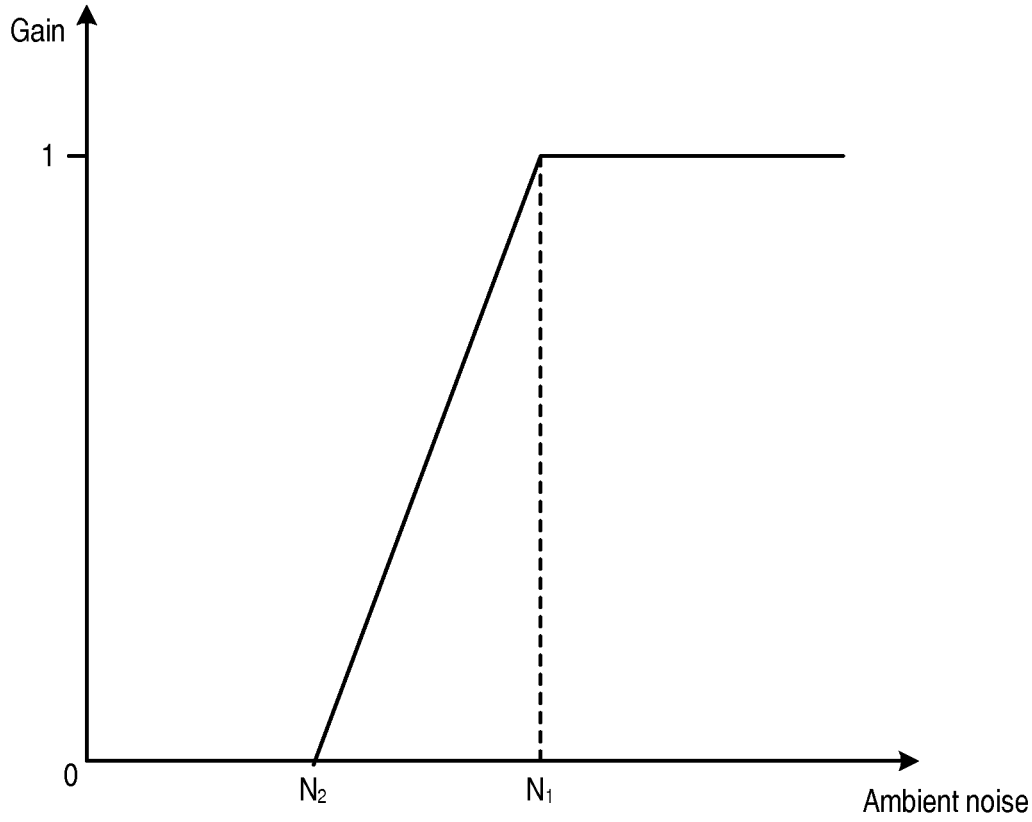
FIG. 3 is a schematic graph showing one embodiment of the variation of applied gain with the detected noise envelope.

Further, according to the present invention, the digital noise signal is input to an envelope detector 54, which detects the envelope of the ambient noise and outputs a control signal to the variable gain block 46. FIG. 3 shows one embodiment, where the envelope detector 54 compares the envelope of the noise signal to a threshold value $N_1$, and outputs the control signal based on the comparison. For example, if the envelope of the noise signal is below the threshold value $N_1$, the envelope detector 54 may output a control signal such that zero gain is applied, effectively turning off the noise cancellation function of the system 10. Similarly, the envelope detector 54 may output a control signal to actually turn off the noise cancellation function of the system 10. In the illustrated embodiment, if the envelope of the noise signal is below the first threshold value $N_1$, the envelope detector 54 outputs a control signal such that the gain is gradually reduced with decreasing noise such that, when a second, lower, threshold value $N_2$ is reached, zero gain is applied. In between the threshold values $N_1$ and $N_2$, the gain is varied linearly; however, a person skilled in the art will appreciate that the gain may be varied in a stepwise manner, or exponentially, for example.

Figure 4:
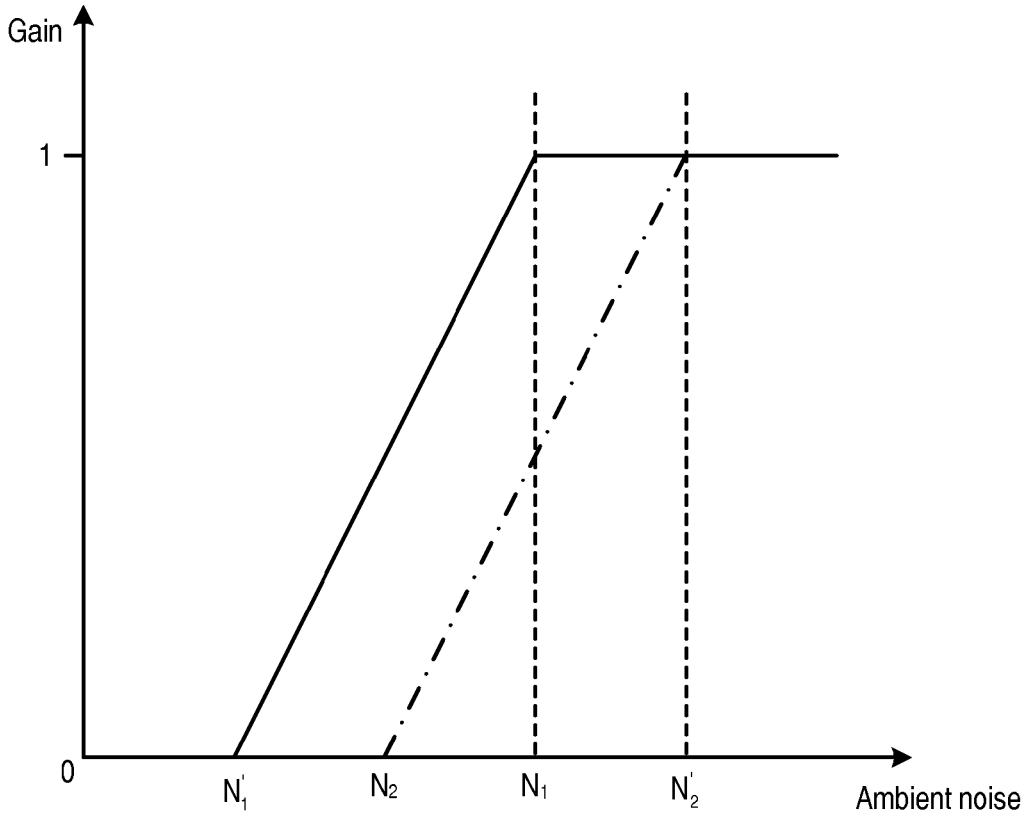
FIG. 4 is a schematic graph showing another embodiment of the variation of applied gain with the detected noise envelope.

FIG. 4 shows a schematic graph of a further embodiment, in which the envelope detector 54 employs a first threshold value $N_1$ and a second threshold value $N_2$ in such a way that a hysteresis is built into the system. The solid line of the graph represents the applied gain when the system is transitioning from a "full" noise cancellation signal to a zero noise cancellation signal; and the chain line represents the applied gain when the system is transitioning from a zero noise cancellation signal to a full noise cancellation signal. In the illustrated embodiment, when the system is initially generating a full noise cancellation signal, but the ambient noise then falls below the first threshold $N_1$, the applied gain is reduced until zero gain is applied at a value $N_1'$ of ambient noise. When the system is initially switched off, or generating a "zero" noise cancellation signal, and the envelope of the ambient noise rises above the second threshold value $N_2$, the applied gain is increased until a full noise cancellation signal is generated at a value $N_2'$ of ambient noise. The second threshold value may be set higher than the value $N_1'$, at which value the noise cancellation was previously switched off, such that a hysteresis is built into the system. The hysteresis prevents rapid fluctuations between noise cancellation "on" and "off" states when the envelope of the noise signal is close to the first threshold value.

A person skilled in the art will appreciate that rather than gradually reducing or increasing the applied gain, the noise cancellation may be switched off or on when the ambient noise crosses the first and second thresholds, respectively. However, in this embodiment the envelope detector 54 of the signal processor 24 may comprise a ramping filter to smooth transitions between different levels of gain. Harsh transitions may sound strange to the user, and by choosing an appropriate time constant for the ramping filter, they can be avoided.

Although in the description above an envelope detector is used to determine the level of ambient noise, alternatively the amplitude of the noise signal may be used instead. The term "noise level", also used in the description, may apply to the amplitude or envelope, or some other magnitude of the noise signal.

Of course, there are many possible alternative methods, not explicitly mentioned here, of altering the addition of the noise cancellation signal to the wanted signal in accordance with the detected ambient noise that would be apparent to those skilled in the art. The present invention is not limited to any one of the described methods, except as defined in the claims appended hereto.

According to a further embodiment of the invention, the digital noise signal output from the ADC 42 is input to the envelope detector 52 via a gate 56. The gate 56 is controlled by a voice activity detector (VAD) 58, which also receives the digital noise signal output from the ADC 42. The VAD 58 then operates the gate 56 such that the noise signal is allowed through to the envelope detector 52 only during voiceless periods. The operation of the gate 56 and the VAD 58 will be described in greater detail below. The VAD 58 and gate 56 are especially beneficial when the noise cancellation system 10 is realized in a mobile phone, or a headset, i.e. any system where the user is liable to be speaking whilst using the system.

The use of a voice activity detector is advantageous because the system includes one or more microphones 20, 22 which detect ambient noise, but which are also close enough to detect the user's own speech. When it is determined that the gain of the noise cancellation system should be controlled on the basis of the ambient noise, it is advantageous to be able to detect the ambient noise level during periods when the user is not speaking.

In the illustrated embodiment of the invention, the ambient noise level is taken to be the noise level during the quietest period within a longer period. Thus, in one embodiment, where the signal from the microphones 20, 22 is converted to a digital signal at a sample rate of 8 kHz, the digital samples are divided into frames, each comprising 256 samples, and the average signal magnitude is determined for each frame. Then, the ambient noise level at any time is determined to be the frame, from amongst the most recent 32 frames, having the lowest average signal magnitude.

Thus, it is assumed that, in each period of 32×256 samples (=approximately 1 second), there will be one frame where the user will not be making any sound, and the detected signal level during this frame will accurately represent the ambient noise.

The gain applied to the noise cancellation signal is then controlled based on ambient noise level determined in this manner. Of course, however, many methods are known for detecting voice activity, and the invention is not limited to any particular method, except as defined in the claims as appended hereto.

Various modifications may be made to the embodiments described above without departing from the scope of the claims appended hereto. For example, a digital noise signal may be input directly to the signal processor 28, and in this case the signal processor 28 would not comprise ADC 42. Further, the VAD 58 may receive an analogue version of the noise signal, rather than the digital signal.

The present invention may be employed in feedforward noise cancellation systems, as described above, or in so-called feedback noise cancellation systems. The general principle of adapting the addition of the noise cancellation signal to the wanted signal in accordance with the detected ambient noise level is applicable to both systems.

Noise cancellation systems according to the present invention may be employed in many devices, as would be appreciated by those skilled in the art. For example, they may be employed in mobile phones, headphones, earphones, headsets, etc.

The skilled person will recognise that the above-described apparatus and methods may be embodied as processor control code, for example on a carrier medium such as a disk, CD- or DVD-ROM, programmed memory such as read only memory (firmware), or on a data carrier such as an optical or electrical signal carrier. For many applications, embodiments of the invention will be implemented on a DSP (digital signal processor), ASIC (application specific integrated circuit) or FPGA (field programmable gate array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (very high speed integrated circuit hardware description language). As the skilled person will appreciate, the code may be distributed between a plurality of coupled components in communication with one another. Where appropriate, the embodiments may also be implemented using code running on a field-(re-)programmable analogue array or similar device in order to configure analogue/digital hardware.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single processor or other unit may fulfil the functions of several units recited in the claims. Any reference signs in the claims shall not be construed so as to limit their scope.

The invention claimed is:

1. A noise cancellation system, for generating a noise cancellation signal to be added to a wanted signal to mitigate the effects of ambient noise, said system comprising:

an input, for receiving an input signal representing ambient noise;

a detector, for detecting a magnitude of said input signal; and a voice activity detector, for detecting voiceless periods when said input signal does not contain a signal representing a voice, wherein said detector is adapted to detect the magnitude of said input signal during said voiceless periods, and wherein the system is adapted to operate in a first mode when said detected magnitude of said input signal is above a threshold value, and a second mode when said detected magnitude of said input signal is below the threshold value, the first mode comprising:

generating a noise cancellation signal with a first magnitude for at least partially cancelling the ambient noise, the noise cancellation signal with said first magnitude being added to the wanted signal;

the second mode comprising:

generating a noise cancellation signal with a second magnitude that is less than the first magnitude, the noise cancellation signal with said second magnitude being added to the wanted signal.

2. A noise cancellation system as claimed in claim 1, wherein the voice activity detector is adapted to generate a plurality of samples of said input signal.

3. A noise cancellation system as claimed in claim 2, wherein said plurality of samples is divided into a plurality of frames, each frame comprising one or more of said plurality of samples.

4. A noise cancellation system as claimed in claim 3, wherein the ambient noise is taken to be the magnitude of the input signal during a frame of the plurality of frames having the lowest average magnitude.

5. A noise cancellation system as claimed in claim 1, wherein said system is adapted to transition from the first mode to the second mode when the magnitude of the input signal falls below the first threshold value, and wherein said system is adapted to transition from the second mode to the first mode when the magnitude of the input signal rises above a second threshold value, said second threshold value being greater than said first threshold value.

6. A noise cancellation system as claimed in claim 1, further comprising:

an adaptive gain element, for applying a first gain value in order to generate said noise cancellation signal with said first magnitude, and for applying a second gain value in order to generate said noise cancellation signal with said second magnitude.

7. A noise cancellation system as claimed in claim 6, wherein said second gain value decreases linearly with the magnitude of the input signal.

8. A noise cancellation system as claimed in claim 1, wherein said second magnitude is zero.

9. An integrated circuit, comprising:

a noise cancellation system as claimed in claim 1.

10. A mobile phone, comprising:

an integrated circuit as claimed in claim 9.

11. A pair of headphones, comprising:

an integrated circuit as claimed in claim 9.

12. A pair of earphones, comprising:

an integrated circuit as claimed in claim 9.

13. A headset, comprising:

an integrated circuit as claimed in claim 9.

14. A noise cancellation system, for generating a noise cancellation signal to be added to a wanted signal to mitigate the effects of ambient noise, said system comprising:

an input, for receiving a signal representing ambient noise;

a detector, for detecting a magnitude of said ambient noise signal; and a voice activity detector, adapted to generate a plurality of samples of said input signal, for detecting voiceless periods when said input signal does not contain a signal representing a voice, wherein said plurality of samples is divided into a plurality of frames, each frame comprising one or more of said plurality of samples, wherein the ambient noise is taken to be the magnitude of the input signal during a frame of the plurality of frames having the lowest average magnitude, wherein said detector is adapted to detect the magnitude of said ambient noise signal during said voiceless periods, wherein the system is adapted to operate in a first mode when said detected magnitude of said ambient noise signal is above a threshold value, and a second mode when said detected magnitude of the ambient noise signal is below the threshold value, the first mode comprising:

generating a noise cancellation signal for at least partially cancelling the ambient noise, the noise cancellation signal being added to the wanted signal;

the second mode comprising:

switching off the noise cancellation system.

15. A noise cancellation system as claimed in claim 14, wherein said system is adapted to transition from the first mode to the second mode when the magnitude of the input signal falls below the first threshold value, and wherein said system is adapted to transition from the second mode to the first mode when the magnitude of the input signal rises above a second threshold value, said second threshold value being greater than said first threshold value.

16. A method of controlling a noise cancellation system, wherein said noise cancellation system is for generating a noise cancellation signal to be added to a wanted signal to mitigate the effects of ambient noise, said system comprising: an input, for receiving an input signal representing ambient noise; a detector, for detecting a magnitude of said input signal; and a voice activity detector, for detecting voiceless periods when said input signal does not contain a signal representing a voice, wherein said detector is adapted to detect the magnitude of said input signal during said voiceless periods, the method comprising: operating in a first mode when said detected magnitude of said input signal is above a threshold value; while operating in said first mode, generating a noise cancellation signal for at least partially cancelling the ambient noise, the noise cancellation signal with said first magnitude being added to the wanted signal; and operating in a second mode when said detected magnitude of said input signal is below the threshold value; and while operating in said second mode, generating a noise cancellation signal with a second magnitude that is less than the first magnitude, the noise cancellation signal with said second magnitude being added to the wanted signal.

17. A method as claimed in claim 16, wherein the voice activity detector generates a plurality of samples of said input signal.

18. A method as claimed in claim 17, wherein said plurality of samples is divided into a plurality of frames, each frame comprising one or more of said plurality of samples.

19. A method as claimed in claim 18 , wherein the ambient noise is taken to be the magnitude of the input signal during a frame of the plurality of frames having the lowest average magnitude.

20. A method as claimed in claim 16, further comprising:

transitioning from the first mode to the second mode when the magnitude of the input signal falls below the first threshold value, and transitioning from the second mode to the first mode when the magnitude of the input signal rises above a second threshold value, wherein said second threshold value is greater than said first threshold value.

21. A method of controlling a noise cancellation system, wherein said noise cancellation system for generating a noise cancellation signal to be added to a wanted signal to mitigate the effects of ambient noise, said system comprising:

an input, for receiving an input signal representing ambient noise;

a detector, for detecting a magnitude of said input signal; and a voice activity detector that generates a plurality of samples of said input signal, for detecting voiceless periods when said input signal does not contain a signal representing a voice, wherein said plurality of samples is divided into a plurality of frames, each frame comprising one or more of said plurality of samples, wherein the ambient noise is taken to be the magnitude of the input signal during a frame of the plurality of frames having the lowest average magnitude, wherein said detector is adapted to detect the magnitude of said input signal during said voiceless periods, the method comprising:

operating in a first mode when said detected magnitude of said input signal is above a threshold value;

while operating in said first mode, generating a noise cancellation signal for at least partially cancelling the ambient noise, the noise cancellation signal being added to the wanted signal; and operating in a second mode when said detected magnitude of said input signal is below the threshold value; and while operating in said second mode, switching off the noise cancellation system.

22. A method as claimed in claim 21, further comprising:

transitioning from the first mode to the second mode when the magnitude of the input signal falls below the first threshold value, and transitioning from the second mode to the normal mode when the magnitude of the input signal rises above a second threshold value, wherein said second threshold value is greater than said first threshold value.

* * * * *